US010465875B2

(12) United States Patent
Nakazato

(10) Patent No.: US 10,465,875 B2
(45) Date of Patent: Nov. 5, 2019

(54) VEHICLE HEADLIGHT

(71) Applicant: STANLEY ELECTRIC CO., LTD., Tokyo (JP)

(72) Inventor: Yoshiaki Nakazato, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/195,369

(22) Filed: Nov. 19, 2018

(65) Prior Publication Data

US 2019/0154225 A1 May 23, 2019

(30) Foreign Application Priority Data

Nov. 22, 2017 (JP) ..... 2017-225182

(51) Int. Cl.

| | |
|---|---|
| ***F21S 41/663*** | (2018.01) |
| ***F21S 41/30*** | (2018.01) |
| ***F21S 41/275*** | (2018.01) |
| ***F21S 41/143*** | (2018.01) |
| ***F21S 41/26*** | (2018.01) |
| ***F21S 41/32*** | (2018.01) |

(Continued)

(52) U.S. Cl.

CPC ..... *F21S 41/663* (2018.01); *F21S 41/143* (2018.01); *F21S 41/151* (2018.01); *F21S 41/26* (2018.01); *F21S 41/275* (2018.01); *F21S 41/30* (2018.01); *F21S 41/321* (2018.01); *F21S 41/323* (2018.01); *F21S 41/36* (2018.01)

(58) Field of Classification Search

CPC ..... F21S 41/663; F21S 41/30; F21S 41/275

USPC ..... 315/82

See application file for complete search history.

(56) References Cited

U.S. PATENT DOCUMENTS

2007/0201241 A1 8/2007 Komatsu
2008/0239746 A1 10/2008 Wuller et al.
2017/0036592 A1* 2/2017 Hoffmann ..... B60Q 1/143

(Continued)

FOREIGN PATENT DOCUMENTS

DE 10 2005 041 234 A1 3/2007
DE 10 2007 008 994 A1 9/2007

(Continued)

OTHER PUBLICATIONS

The extended European Search Report for the related European Patent Application No. 18206694.4 dated Apr. 23, 2019.

*Primary Examiner* — Don P Le
(74) *Attorney, Agent, or Firm* — Kenealy Vaidya LLP

(57) ABSTRACT

A vehicle headlight includes a first light distribution variable lighting unit and a second light distribution variable lighting unit each having a plurality of light emitting devices and a projection lens that projects light emitted from the plurality of light emitting devices and that are configured to variably control a light distribution pattern of light emitted from the projection lens while switching lighting of the plurality of light emitting devices, wherein the first light distribution variable lighting unit radiates light having a first light distribution pattern toward a side in front of the projection lens with respect to a predetermined radiation range, and the second light distribution variable lighting unit radiates light having a second light distribution pattern toward the side in front of the projection lens with respect to at least a vicinity of a reference center of the radiation range.

10 Claims, 7 Drawing Sheets

(51) Int. Cl.
*F21S 41/36* (2018.01)
*F21S 41/151* (2018.01)

(56) References Cited

U.S. PATENT DOCUMENTS

| | | | | |
|---|---|---|---|---|
| 2018/0031200 | A1* | 2/2018 | Park | B60Q 1/143 |
| 2018/0335192 | A1* | 11/2018 | Tanaka | G02B 27/0977 |
| 2018/0356060 | A1* | 12/2018 | Kasano | F21S 41/147 |
| 2019/0001868 | A1* | 1/2019 | Kaino | B60Q 1/1423 |
| 2019/0009705 | A1* | 1/2019 | Tanaka | B60Q 1/076 |

FOREIGN PATENT DOCUMENTS

| | | | |
|---|---|---|---|
| DE | 10 2016 107 252 | A1 | 11/2016 |
| EP | 2 586 659 | A1 | 5/2013 |
| EP | 2 620 695 | A2 | 7/2013 |
| EP | 2 784 376 | A2 | 10/2014 |
| EP | 3 173 688 | A1 | 5/2017 |
| JP | 2004-311101 | A | 11/2004 |

* cited by examiner

VEHICLE HEADLIGHT

CROSS-REFERENCE TO RELATED APPLICATION

Priority is claimed on Japanese Patent Application No. 2017-225182, filed Nov. 22, 2017, the content of which is incorporated herein by reference.

BACKGROUND OF THE INVENTION

Field of the Invention

The present invention relates to a vehicle headlight.

Description of Related Art

In the related art, for a vehicle headlight mounted on a vehicle, there is a configuration including a plurality of light emitting devices disposed to be arranged in a vehicle width direction, and a projection lens configured to project light emitted from the plurality of light emitting devices in an advancing direction of the vehicle (for example, see Japanese Unexamined Patent Application, First Publication No. 2004-311101).

With regard to this, development of a variable light distribution headlamp (an adaptive driving beam (ADB)) configured to variably control a light distribution pattern of light projected by a projection lens while switching the lighting of a plurality of light emitting devices is progressing. An ADB is a technology for allowing recognition of a preceding vehicle, an oncoming vehicle, a pedestrian, or the like, using an in-vehicle camera and enlarging a field of view in front of a driver at nighttime without causing glare for a driver or a pedestrian in front of the vehicle.

SUMMARY OF THE INVENTION

Incidentally, when a plurality of light emitting devices are disposed to be arranged in a vehicle width direction, it is extremely difficult to dispose them parallel to each other with no gaps therebetween. For this reason, in the vehicle headlight in the related art, when the plurality of light emitting devices are turned on, since a dark area (a region to which light is not radiated) corresponding to a gap between the light emitting devices occurs, a clear cutoff line (a light-shade boundary) occurs in a light distribution pattern of the light projected by the projection lens.

In this case, the clear cutoff line formed in the light distribution pattern may be annoying for a driver. Accordingly, it is necessary to moderately blur such a cutoff line.

Meanwhile, in order to blur a cutoff line, when the light emitted from the light emitting device is diffused in the vehicle width direction, a central luminous intensity of a light distribution pattern is decreased. In this case, in order to raise the central luminous intensity of the light distribution pattern, it is simply necessary to enlarge the projection lens, but this will lead to an increase in size of the vehicle headlight.

An aspect of the present invention is directed to providing a vehicle headlight capable of obtaining a good light distribution pattern and reducing a size of a projection lens without annoying the driver by a clear cutoff line.

A vehicle headlight according to an aspect of the present invention includes a first light distribution variable lighting unit and a second light distribution variable lighting unit each having a plurality of light emitting devices disposed to be aligned in a vehicle width direction and a projection lens that projects light emitted from the plurality of light emitting devices in an advancing direction of a vehicle and that are configured to variably control a light distribution pattern of the light projected by the projection lens while switching lighting of the plurality of light emitting devices, wherein the first light distribution variable lighting unit radiates light having a first light distribution pattern toward a side in front of the projection lens with respect to a predetermined radiation range, and the second light distribution variable lighting unit radiates light having a second light distribution pattern toward the side in front of the projection lens with respect to at least a vicinity of a reference center of the radiation range.

In the aspect of the present invention, a luminous intensity of light radiated to the vicinity of the reference center of the radiation range may be maximized by causing the light having the second light distribution pattern to overlap the light having the first light distribution pattern.

In the aspect of the present invention, the second light distribution variable lighting unit may cause a single peak intensity to appear in a luminous intensity distribution of a projection image when light radiated to a side in front of the projection lens is projected with respect to a virtual vertical screen facing the projection lens by causing light emitted from neighboring light emitting devices to overlap each other.

In the aspect of the present invention, an optical axis of light emitted from the light emitting devices that constitute the second light distribution variable lighting unit may be disposed between optical axes of light emitted from the light emitting devices that constitute the first light distribution variable lighting unit.

In the aspect of the present invention, a number of the light emitting devices that constitute the second light distribution variable lighting unit may be smaller than a number of the light emitting devices that constitute the first light distribution variable lighting unit.

In the aspect of the present invention, the projection lens that constitutes the second light distribution variable lighting unit may be smaller than the projection lens that constitutes the first light distribution variable lighting unit.

In the aspect of the present invention, the projection lens may have an optical diffusion section configured to diffuse light emitted from the projection lens.

In the aspect of the present invention, each of the first light distribution variable lighting unit and the second light distribution variable lighting unit may have a separator configured to reflect light emitted from the light emitting device toward the projection lens.

According to the aspect of the present invention, it is possible to provide a vehicle headlight capable of obtaining a good light distribution pattern and further enabling reduction in size of a projection lens without annoying the driver by a clear cutoff line.

DETAILED DESCRIPTION OF THE INVENTION

Figure 1:
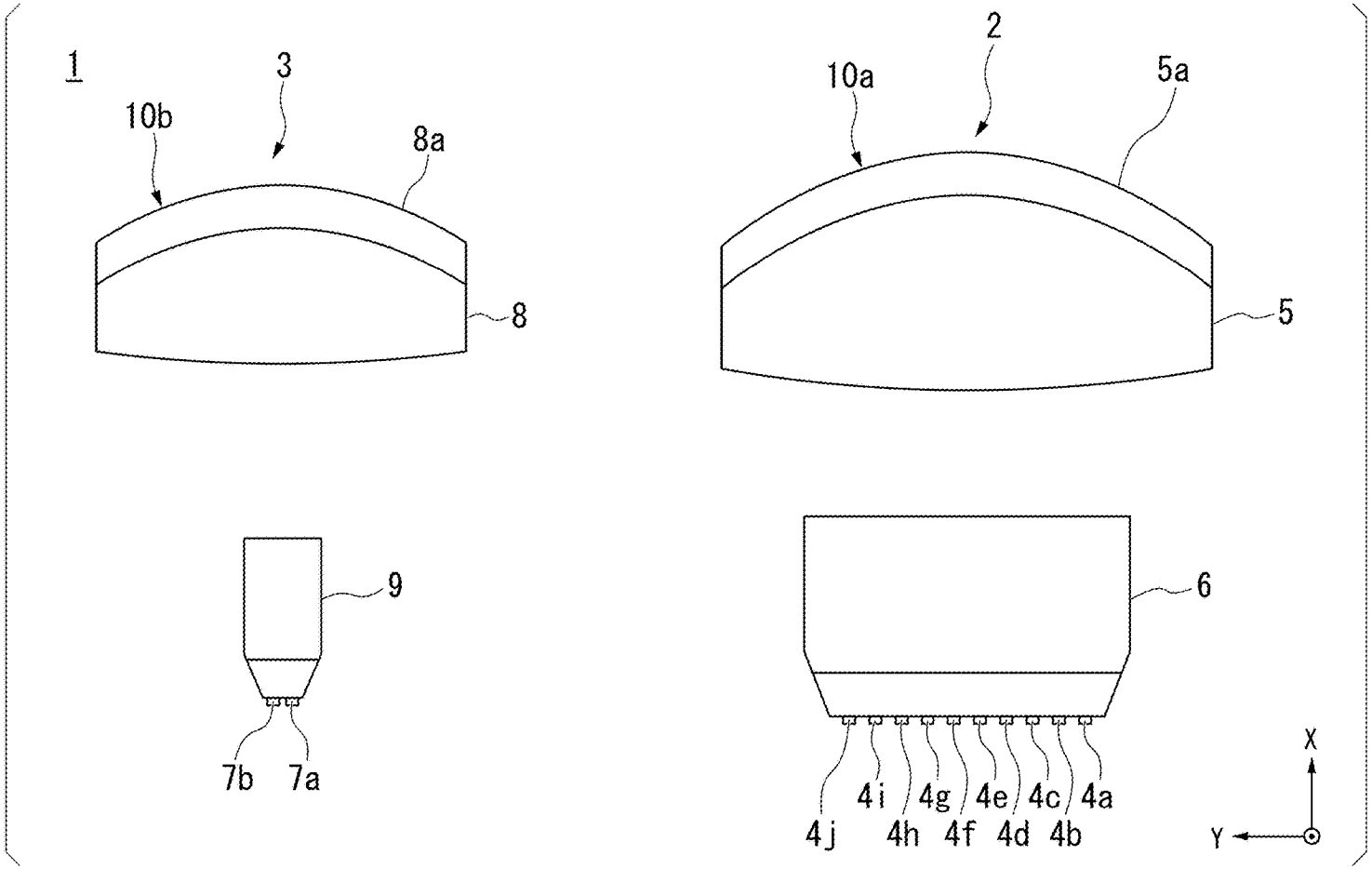
FIG. 1 is a plan view showing a schematic configuration of a vehicle headlight according to an embodiment of the present invention.

Hereinafter, an embodiment of the present invention will be described with reference to the accompanying drawings.

In the drawings used in the following description, in order to make respective components easy to see, there are instances where the dimensional sizes are made different depending on the constituent elements, and the dimensional proportions of respective components may not necessarily be the same as actual ones. In addition, materials, dimensions, and so on, exemplified in the following descriptions are merely examples, and the present invention is not limited thereto and may be made with appropriate modifications without departing from the scope of the present invention.

For example, a vehicle headlight 1 shown in FIG. 1 to FIG. 4 will be described as an embodiment of the present invention.

Figure 2:
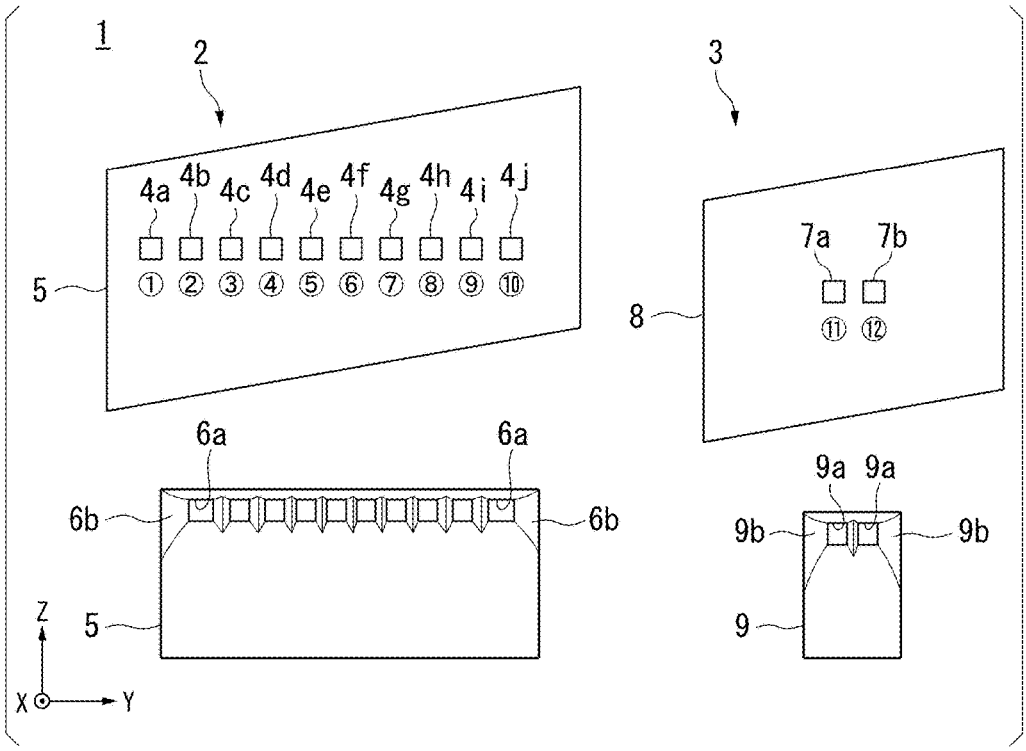
FIG. 2 is an exploded view of components of a first light distribution variable lighting unit and a second light distribution variable lighting unit when seen from a front side.
Figure 3:
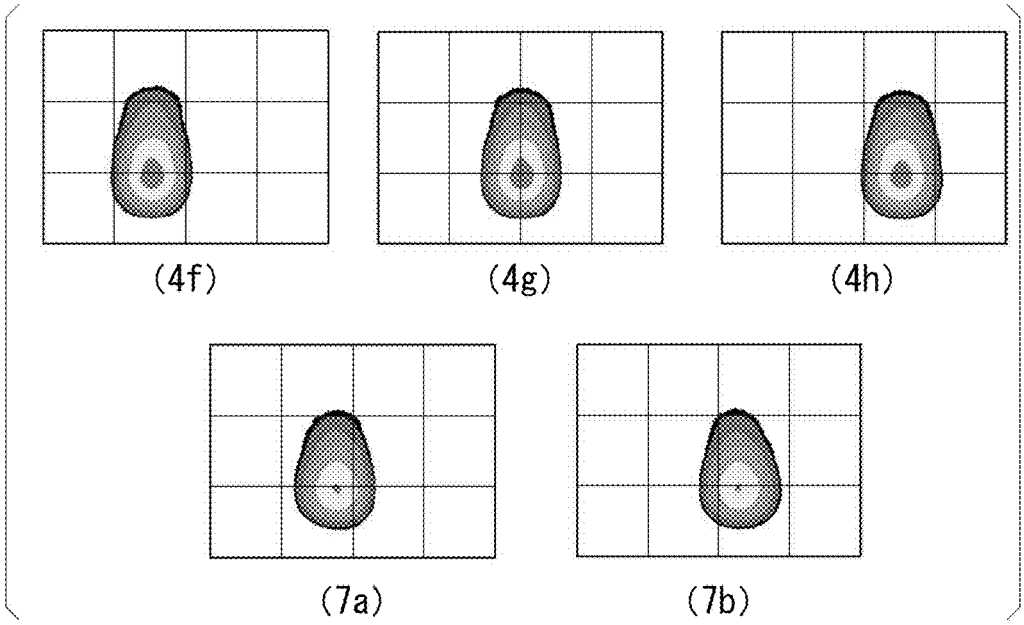
FIG. 3 is a view showing disposition of each of the light emitting devices and a projection image of light emitted from each of the light emitting devices in the vicinity of a reference center of the first light distribution variable lighting unit and the second light distribution variable lighting unit.
Figure 4:
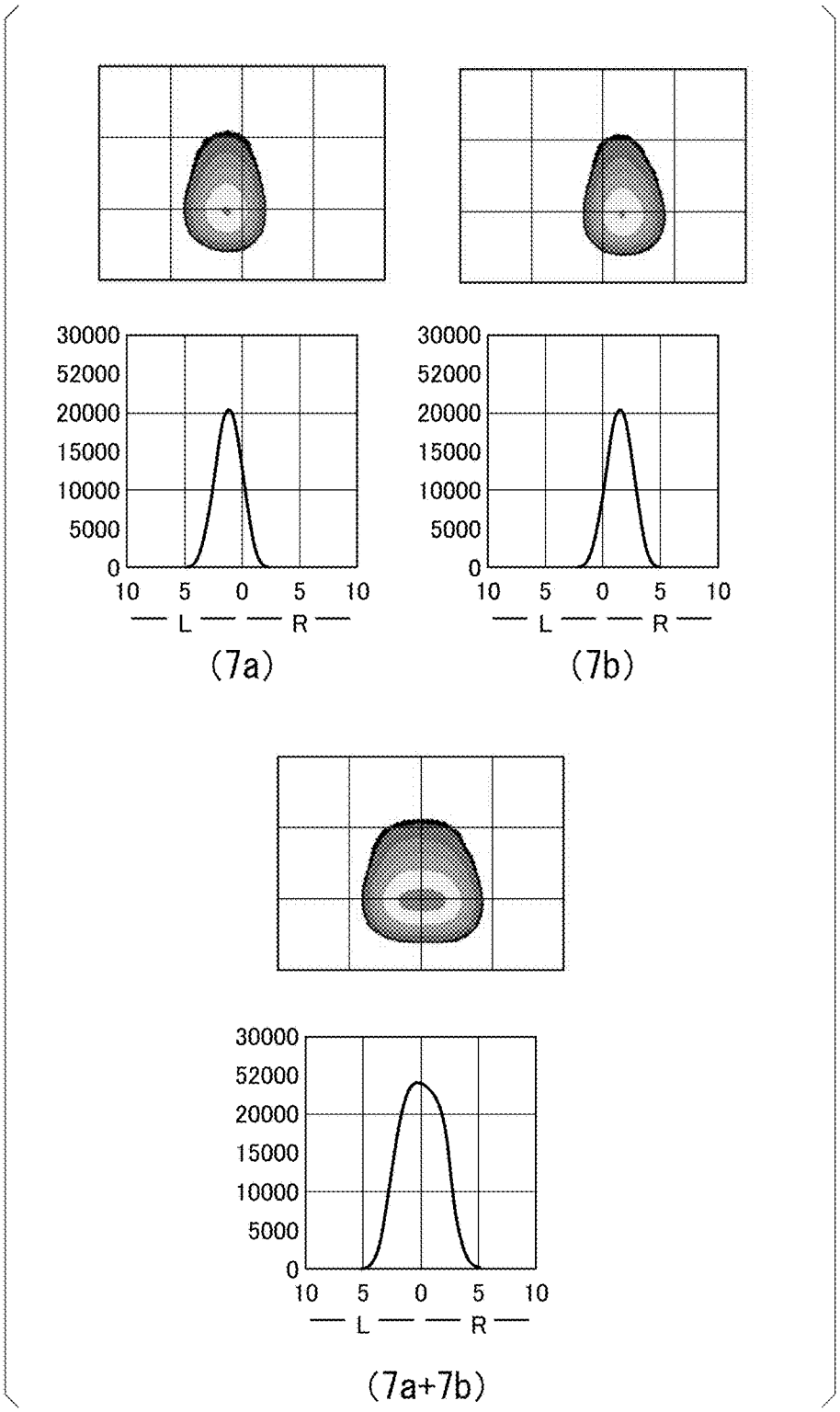
FIG. 4 is a view showing a projection image of light emitted from the neighboring light emitting devices of the second light distribution variable lighting unit and a luminous intensity distribution thereof, and a projection image of the overlapped light and a luminous intensity distribution thereof.

Further, FIG. 1 is a plan view showing a schematic configuration of the vehicle headlight 1. FIG. 2 is an exploded view of configurations of a first light distribution variable lighting unit 2 and a second light distribution variable lighting unit 3 when seen from a front side. FIG. 3 is a view showing disposition of each of the light emitting devices 4*f*, 4*g*, 4*h*, 7*a* and 7*b* and a projection image of light emitted from each of the light emitting devices 4*f*, 4*g*, 4*h*, 7*a* and 7*b* in the vicinity of a reference center of the first light distribution variable lighting unit 2 and the second light distribution variable lighting unit 3. FIG. 4 is a view showing a projection image of light emitted from the neighboring light emitting devices 7*a* and 7*b* of the second light distribution variable lighting unit 3 and a luminous intensity distribution thereof, and a projection image of overlapped light and a luminous intensity distribution thereof.

In addition, in the following drawings, an XYZ orthogonal coordinate system is set, an X-axis direction represents a forward and rearward direction of the vehicle headlight 1, a Y-axis direction represents a leftward and rightward direction of the vehicle headlight 1, and a Z-axis direction represents an upward and downward direction of the vehicle headlight 1.

For example, the lighting tool 1 for a vehicle of the embodiment may be a lighting tool obtained by applying the present invention to headlight (headlamps) for a vehicle mounted on both of corner sections of a front side of the vehicle (not shown). Further, the headlight (headlamps) for a vehicle disposed at both of left and right sides of the vehicle basically have the same structure except that they have a laterally symmetrical structure. Accordingly, in the embodiment, the structure will be described in detail while referring the headlight (headlamp) for a vehicle on the left side of the vehicle as the lighting tool 1 for a vehicle.

In addition, directions of"forward," "rearward," "leftward," "rightward," "upward" and "downward," in the following description are the same as directions when the lighting tool 1 for a vehicle is seen from a front surface (front of the vehicle) unless the context clearly indicates otherwise.

As shown in FIG. 1 and FIG. 2, the lighting tool 1 for a vehicle of the embodiment generally includes the first light distribution variable lighting unit 2 and the second light distribution variable lighting unit 3 that are configured to radiate light toward a side in front of the vehicle (a +X-axis direction). The first and second light distribution variable lighting units 2 and 3 constitute a variable light distribution headlamp (ADB) configured to variably control a light distribution pattern of light. Further, the first and second light distribution variable lighting units 2 and 3 are disposed at a corner section of a left front end side of the vehicle while being accommodated in a lighting body (not shown) that constitutes the lighting tool 1 for a vehicle.

The first light distribution variable lighting unit 2 has a plurality of (in the embodiment, 10) light emitting devices 4*a* to 4*j* disposed to be aligned in a vehicle width direction (the Y-axis direction), a first projection lens 5 configured to project light emitted from the plurality of light emitting devices 4*a* to 4*j* in an advancing direction of the vehicle (the +X-axis direction), and a first separator 6 configured to reflect the light emitted from the light emitting devices 4*a* to 4*j* toward the first projection lens 5.

The second light distribution variable lighting unit 3 has a plurality of (in the embodiment, two) light emitting devices 7*a* and 7*b* disposed to be aligned in the vehicle width direction (the Y-axis direction), a second projection lens 8 configured to project light emitted from the plurality of light emitting devices 7*a* and 7*b* in the vehicle advancing direction (the +X-axis direction), and a second separator 9 configured to reflect the light emitted from the light emitting devices 7*a* and 7*b* toward the second projection lens 8.

The light emitting devices 4*a* to 4*j* and the light emitting devices 7*a* and 7*b* are constituted by light emitting diodes (LEDs) configured to emit white light (hereinafter, simply referred to as light). In addition, a high output type LED for lighting used in a vehicle is used as the LED. The light emitting devices 4*a* to 4*j* and the light emitting devices 7*a* and 7*b* radially emit light toward the first projection lens 5 and the second projection lens 8.

The plurality of light emitting devices 4*a* to 4*j* that constitute the first light distribution variable lighting unit 2 are non-symmetrically disposed with respect to a focus of the first projection lens 5 in the vehicle width direction (the Y-axis direction). That is, in the plurality of light emitting devices 4*a* to 4*j*, six light emitting device 4*a* to 4*f* (first to sixth from a left side in FIG. 2) and three light emitting device 4*h* to 4*j* (from eighth to tenth from the left side in FIG. 2) are non-symmetrically disposed to be arranged about one light emitting device 4*g* (seventh from the left side in FIG. 2) in the vehicle width direction (the Y-axis direction).

In addition, the light emitting device 7*a* of one side and the light emitting device 7*b* of the other side that constitute the second light distribution variable lighting unit 3 are disposed at positions symmetrical with respect to a focus of the second projection lens 8 in the vehicle width direction (the Y-axis direction).

Further, for the light emitting devices 4*a* to 4*j* and the light emitting devices 7*a* and 7*b*, those of the same output (size) may be used, but those having different outputs (sizes) may be used. In addition, for the light emitting devices that constitute the first and second light distribution variable lighting units 2 and 3, in addition to the above-mentioned LED, a semiconductor light emitting device such as a laser diode (LD) or the like may be used.

Each of the first projection lens 5 and the second projection lens 8 is constituted by a single lens or a compound lens (in the embodiment, one convex lens) obtained by combining a plurality of lens. Further, a material having a higher refractive index than that of air, for example, a transparent resin such as polycarbonate, acryl, or the like, glass, or the like, may be used for the lens.

Optical diffusion sections 10*a* and 10*b* are formed on a front surface 5*a* of the first projection lens 5 and a front surface 8*a* of the second projection lens 8. The optical diffusion sections 10*a* and 10*b* have a configuration in which concavo-convex structures configured to diffuse light in the leftward and rightward direction (the Y-axis direction) and the upward and downward direction (the Z-axis direction) that are referred to as fisheye cuts are formed on the front surfaces (emitting surfaces) 5*a* and 8*a* of the first projection lens 5 and the second projection lens 8.

In the optical diffusion sections 10*a* and 10*b*, a diffusion level of light emitted from the front surface 5*a* of the first projection lens 5 and the front surface 8*a* of the second projection lens 8 can be controlled by adjusting a shape or the like of the fisheye cuts.

Further, the optical diffusion sections 10*a* and 10*b* are not necessarily limited to the configuration constituted by the above-mentioned fisheye cuts, and may have a configuration in which a plurality of reflection cuts or the like configured to diffuse light emitted from the front surface 5*a* of the first projection lens 5 and the front surface 8*a* of the second projection lens 8 are formed.

The first separator 6 and the second separator 9 are constituted by a die casting member formed of metal through, for example, aluminum vapor deposition, and disposed in front of the light emitting devices 4*a* to 4*j* and the light emitting devices 7*a* and 7*b*. Further, the first separator 6 and the second separator 9 may be formed of, for example, a white resin molded member.

The first separator 6 and the second separator 9 have a plurality (in the embodiment, ten) opening sections 6*a* and a plurality of (in the embodiment, two) opening sections 9*a* that are aligned in the vehicle width direction (the Y-axis direction). Each of the opening sections 6*a* and the opening sections 9*a* opens in a rectangular shape when seen in a front view at a position facing each of the light emitting devices 4*a* to 4*j* and the light emitting devices 7*a* and 7*b*.

In addition, the first separator 6 and the second separator 9 have a reflective surface 6*b* and a reflective surface 9*b* that surround the opening sections 6*a* and the opening sections 9*a*. The reflective surface 6*b* and the reflective surface 9*b* are disposed on the front surface sides of the first separator 6 and the second separator 9 and is constituted by four inclined surfaces that are inclined from the surroundings of the opening sections 6*a* and the opening sections 9*a* toward four directions (upward, downward, leftward and rightward).

Accordingly, in the first separator 6 and the second separator 9, the light passing through the opening sections 6*a* and the opening sections 9*a* and reflected by the reflective surface 6*b* and the reflective surface 9*b* can be diffused in the vehicle width direction (the Y-axis direction) and the vehicle upward and downward direction (the Z-axis direction).

In the lighting tool 1 for a vehicle of the embodiment having the above-mentioned configuration, the first light distribution variable lighting unit 2 variably controls a light distribution pattern (hereinafter, referred to as a first light distribution pattern) of light projected by the first projection lens 5 while switching lighting of the plurality of light emitting devices 4*a* to 4*j*. In addition, the first light distribution variable lighting unit 2 that is a main variable light distribution headlamp (ADB) radiates light having a first light distribution pattern with respect to a predetermined radiation range toward a side in front of the first projection lens 5 (the +X-axis direction).

The second light distribution variable lighting unit 3 variably controls a light distribution pattern (hereinafter, referred to as a second light distribution pattern) of light projected by the second projection lens 8 while switching lighting of the plurality of light emitting devices 7*a* and 7*b*. In addition, as an additional subsidiary variable light distribution headlamp (ADB), the second light distribution variable lighting unit 3 radiates light having a second light distribution pattern toward a side in front of the second projection lens 8 (in the +X-axis direction) with respect to at least the vicinity of the reference center (a substantially central portion), among the radiation range to which the above mentioned light having the first light distribution pattern is radiated.

Accordingly, in the lighting tool 1 for a vehicle of the embodiment, since the light having the second light distribution pattern is overlapped with the light having the first light distribution pattern, a luminous intensity of light radiated to the vicinity of the reference center (the substantially central portion) of the radiation range is maximized.

In the lighting tool 1 for a vehicle of the embodiment, since a cutoff line formed in the first light distribution pattern is appropriately blurred, the light emitted from the light emitting devices 4*a* to 4*j* can be diffused by the optical diffusion section 10*a* formed on the first projection lens 5 or the reflective surface 6*b* formed on the first separator 6.

In this case, although the luminous intensity in the vicinity of the reference center (hereinafter, referred to as central luminous intensity) of the first light distribution pattern is decreased, the central luminous intensity can be increased since the light having the second light distribution pattern is overlapped with the light having the first light distribution pattern.

Accordingly, in the lighting tool 1 for a vehicle of the embodiment, a good light distribution pattern can be obtained without annoying the driver by the clear cutoff line. In addition, since the lighting tool 1 is divided into the first light distribution variable lighting unit 2 and the second light distribution variable lighting unit 3, reduction in size of the first projection lens 5 and the second projection lens 8 can be achieved without causing a decrease in central luminous intensity.

In addition, in the lighting tool 1 for a vehicle of the embodiment, as shown in FIG. 3, an optical axis of light emitted from the light emitting devices 7*a* and 7*b* that constitute the second light distribution variable lighting unit 3 is disposed between optical axes of light emitted from the light emitting devices 4*f* to 4*h* that constitute the first light distribution variable lighting unit 2.

Specifically, in the embodiment, among the 10 light emitting devices 4*a* to 4*j* that constitute the first light distribution variable lighting unit 2, an optical axis of light emitted from the light emitting device 7*a*, which is one member (first from a left side in FIG. 2) that constitutes the second light distribution variable lighting unit 3, is disposed in between the optical axes of light emitted from the light emitting device 4*g*, that is set as the reference center (seventh from the left side in FIG. 2), and the optical axis of light emitted from the light emitting device 4*f* which is one of the light emitting device being (sixth from the left side in FIG. 2) adjacent to the light emitting device 4*g*. In addition, an optical axis of light emitted from the light emitting device 7*b*, which is the other member (second from the left side in FIG. 2) that constitutes the second light distribution variable lighting unit 3, is disposed in between the optical axes of light emitted from the light emitting device 4*g*, that is set as the reference center (seventh from the left side in FIG. 2), and the optical axis of light emitted from the light emitting device 4*h* which is the other one of the light emitting device being (eighth from the left side in FIG. 2) adjacent to the light emitting device 4*g*.

In this case, light emitted from the light emitting devices 4*f*, 4*g* and 4*h* that constitute the first light distribution variable lighting unit 2 and light emitted from the light emitting devices 7*a* and 7*b* that constitute the second light distribution variable lighting unit 3 alternately overlap each other in the vehicle width direction (the Y-axis direction). For this reason, an effect of narrowing intervals between the light emitting devices 4*f*, 7*a*, 4*g*, 7*b* and 4*h* that are substantially adjacent to each other (an effect of improving a resolution of the ADB) can be obtained. Accordingly, in the lighting tool 1 for a vehicle of the embodiment, a better light distribution pattern can be obtained.

In addition, as shown in FIG. 4, the second light distribution variable lighting unit 3 causes a single peak intensity to appear in the luminous intensity distribution of the projection image when light radiated to a side in front of the second projection lens 8 is projected with respect to a virtual vertical screen facing the second projection lens 8 by causing light emitted from the neighboring light emitting devices 7*a* and 7*b* to overlap.

In the embodiment, when light emitted from the neighboring light emitting devices 7*a* and 7*b* overlap each other, light emitted from the light emitting devices 7*a* and 7*b* is diffused in the vehicle width direction by the optical diffusion section 10*b* formed on the second projection lens 8 or the reflective surface 9*b* formed on the second separator 9 such that two peak intensities corresponding to the light emitting devices 7*a* and 7*b* do not appear in the luminous intensity distribution of the projection image.

Accordingly, it is possible to appropriately blur a cutoff line formed in the second light distribution pattern. In addition, a single peak intensity (a maximum peak intensity) that appears at a substantially central portion of the luminous intensity distribution of the projection image can be increased to be higher than when two peak intensities appear in the luminous intensity distribution of the projection image.

Further, in FIG. 4, the maximum peak intensity in the luminous intensity distribution of the projection image of the overlapped light shows a value higher by about 20% than the maximum peak intensity in the luminous intensity distribution of the projection image of the light emitted from the light emitting devices 7*a* and 7*b*.

Figure 5A:
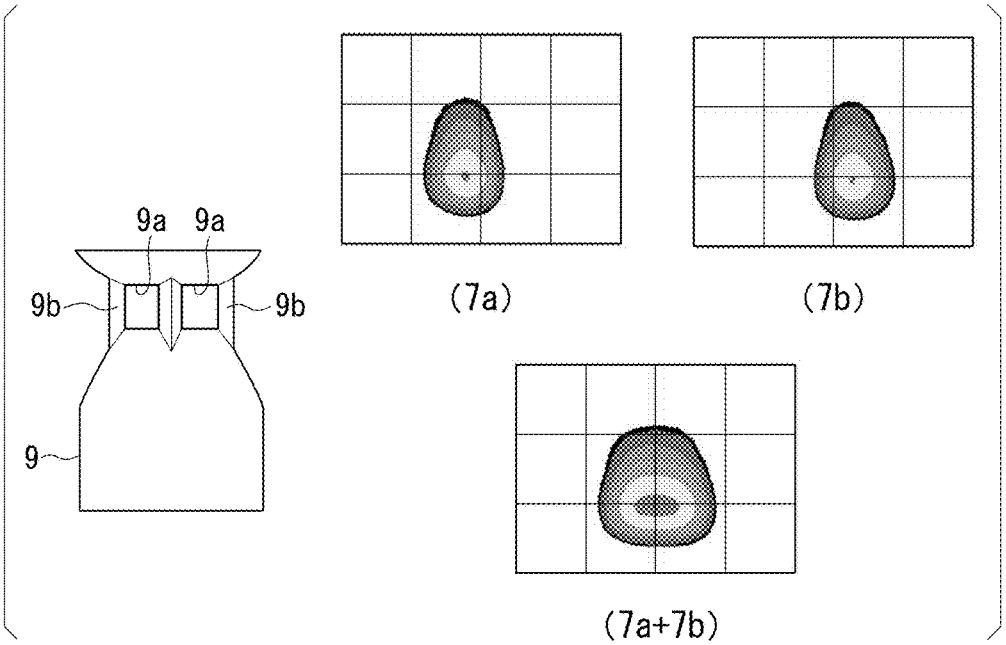
FIG. 5A is a view showing a projection image of light emitted from the neighboring light emitting device when a shape of a reflective surface of a second separator is changed and a luminous intensity distribution thereof, and a projection image of the overlapped light and a luminous intensity distribution thereof.
Figure 5B:
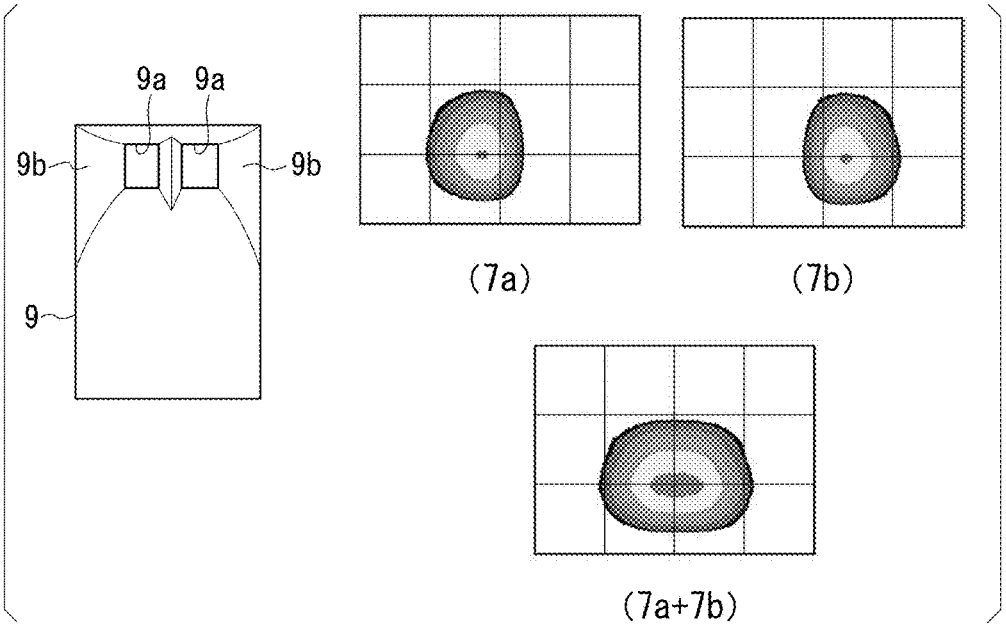
FIG. 5B is a view showing a projection image of light emitted from the neighboring light emitting devices when a shape of the reflective surface of the second separator is changed and a luminous intensity distribution thereof, and a projection image of overlapped light and a luminous intensity distribution thereof.

Here, the projection image of the light emitted from the neighboring light emitting devices 7*a* and 7*b* when a shape of a reflective surface 9*a* of the second separator 9 is changed and the luminous intensity distribution thereof, and the projection image of the overlapped light and the luminous intensity distribution thereof are shown in FIG. 5A and FIG. 5B.

Further, FIG. 5A shows a case in which a shape of the reflective surface 9*a* disposed at both of outer sides of the neighboring light emitting devices 7*a* and 7*b* is the same as the shape of the reflective surface 6*a* of the first separator 6. Meanwhile, FIG. 5B shows a case in which a shape of the reflective surface 9*a* disposed at both of outer sides of the neighboring light emitting devices 7*a* and 7*b* is enlarged to be larger than a shape of a reflective surface 6*a* of the first separator 6 in the vehicle width direction (the Y-axis direction).

As shown in FIG. 5A, when the shape of the reflective surface 9*a* disposed at both of outer sides of the neighboring light emitting devices 7*a* and 7*b* is the same as the shape of the reflective surface 6*a* of the first separator 6, a diffusion level of light emitted from the light emitting devices 4*f*, 7*a*, 4*g*, 7*b* and 4*h* in the vicinity of the reference center (a substantially central portion) can be substantially uniformized.

Meanwhile, as shown in FIG. 5B, when the shape of the reflective surface 9*a* disposed at both of outer sides of the neighboring light emitting devices 7*a* and 7*b* is enlarged in the vehicle width direction (the Y-axis direction), since a diffusion level of light emitted from the light emitting devices 7*a* and 7*b* can be increased to be higher than a diffusion level of light emitted from the light emitting devices 4*f*, 4*g* and 4*h* in the vicinity of the reference center (a substantially central portion), a range of the high luminous intensity can be enlarged in the vehicle width direction (the Y-axis direction).

Figure 6A:
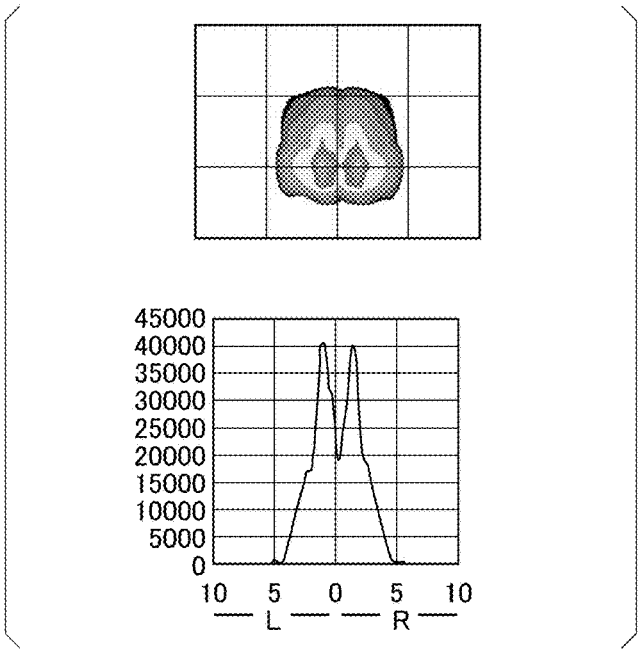
FIG. 6A is a view showing a projection image of overlapped light and a luminous intensity distribution thereof according to a presence of an optical diffusion section or a difference in diffusion level in a second projection lens.
Figure 6B:
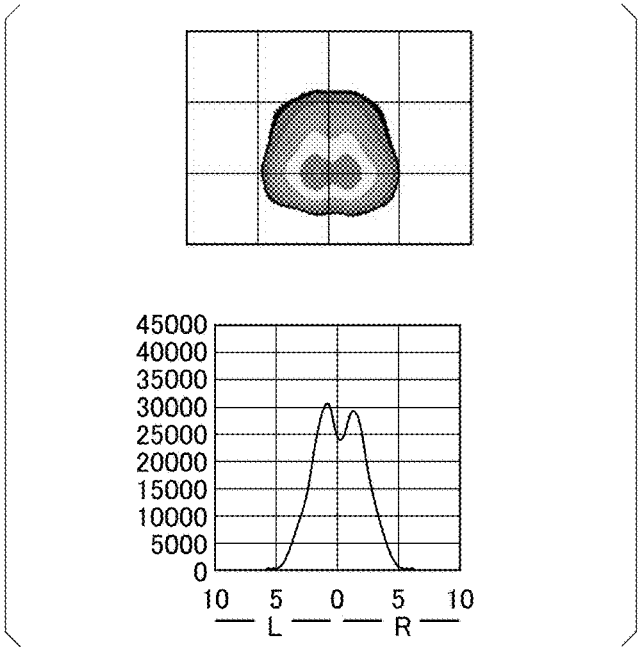
FIG. 6B is a view showing a projection image of overlapped light and a luminous intensity distribution thereof according to a presence of an optical diffusion section or a difference in diffusion level in a second projection lens.
Figure 6C:
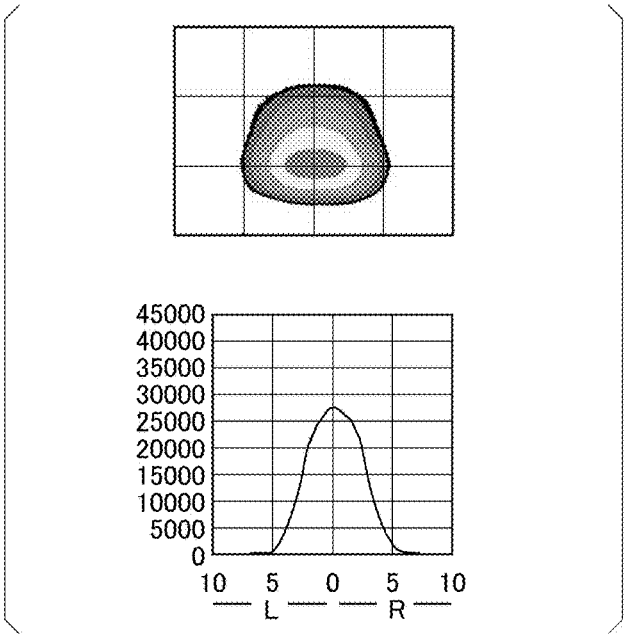
FIG. 6C is a view showing a projection image of overlapped light and a luminous intensity distribution thereof according to a presence of an optical diffusion section or a difference in diffusion level in a second projection lens.
Figure 6D:
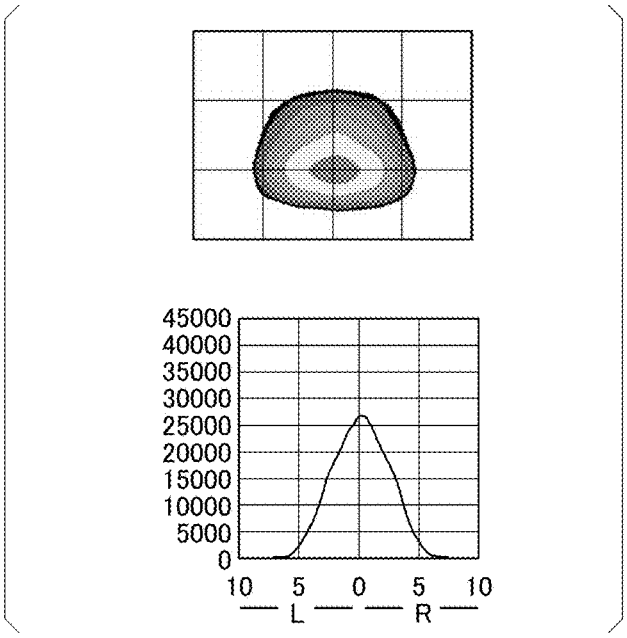
FIG. 6D is a view showing a projection image of overlapped light and a luminous intensity distribution thereof according to a presence of an optical diffusion section or a difference in diffusion level in a second projection lens.

In addition, a projection image of the overlapped light and a luminous intensity distribution thereof according to presence of the optical diffusion section 10*b* of the second projection lens 8 or a difference of a diffusion level are shown in FIG. 6A, FIG. 6B, FIG. 6C and FIG. 6D. Further, FIG. 6A shows a case in which the optical diffusion section 10*b* is omitted as a reference. FIG. 6B shows a case in which a diffusion level of the optical diffusion section 10*b* is lowered as a reference. FIG. 6C shows a case in which a diffusion level of the optical diffusion section 10*b* is optimized. FIG. 6D shows a case in which a diffusion level of the optical diffusion section 10*b* is increased.

As shown in FIG. 6A and FIG. 6B, in the case in which the optical diffusion section 10*b* is omitted or the diffusion level is lowered, when light emitted from the neighboring light emitting devices 7*a* and 7*b* overlap each other, two peak intensities corresponding to the light emitting devices 7*a* and 7*b* appears in the luminous intensity distribution of the projection image. In this case, a clear cutoff line is generated in the second light distribution pattern due to a decrease in central luminous intensity.

On the other hand, as shown in FIG. 6C, in the case in which a diffusion level of the optical diffusion section 10*b* is optimized, when light emitted from the neighboring light emitting devices 7*a* and 7*b* overlap each other, the central luminous intensity of the luminous intensity distribution of the projection image can be maximized, and it is possible to appropriately blur the cutoff line generated in the second light distribution pattern.

Further, as shown in FIG. 6D, in the case in which a diffusion level of the optical diffusion section 10*b* is increased, when light emitted from the neighboring light emitting devices 7*a* and 7*b* overlap each other, a range of the high luminous intensity can be enlarged in the vehicle width direction (the Y-axis direction) while a maximum value of the central luminous intensity of the luminous intensity distribution of the projection image is decreased to be smaller than when shown in FIG. 6C.

In addition, in the lighting tool 1 for a vehicle of the embodiment, the second projection lens 8 is preferably smaller than the first projection lens 5.

Figure 7A:
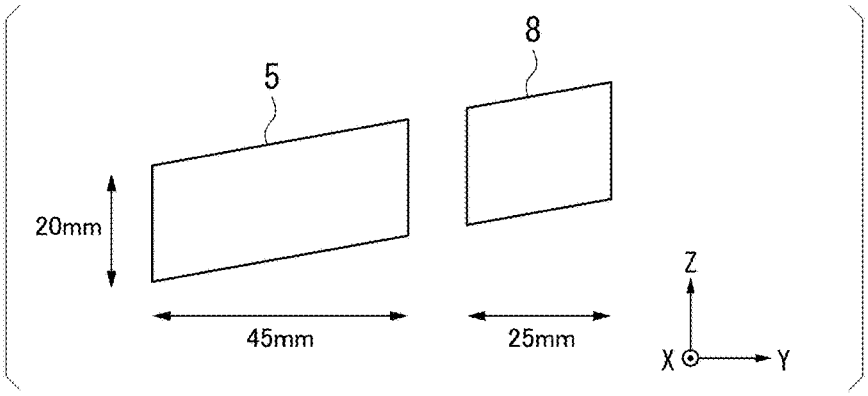
FIG. 7A is a front view showing a case in which sizes of a first projection lens and a second projection lens are changed.
Figure 7B:
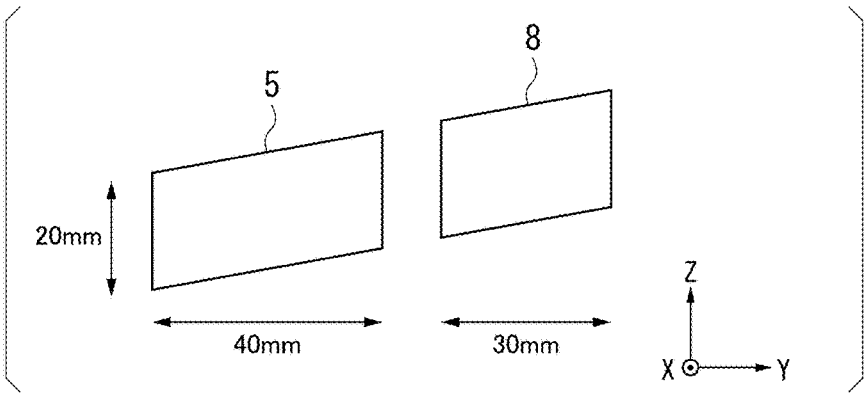
FIG. 7B is a front view showing a case in which sizes of the first projection lens and the second projection lens are changed.
Figure 7C:
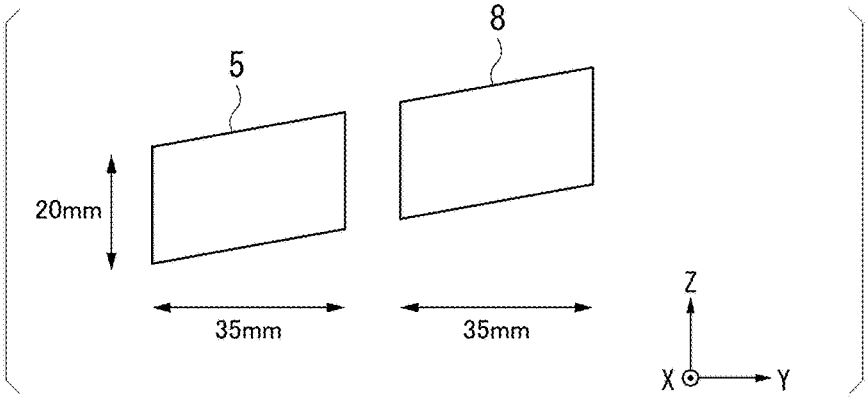
FIG. 7C is a front view showing a case in which sizes of the first projection lens and the second projection lens are changed.

Here, the case in which sizes of the first projection lens 5 and the second projection lens 8 are changed are shown in FIG. 7A. FIG. 7B and FIG. 7C. Further, FIG. 7A shows a case in which a lateral dimension of the first projection lens 5 is 45 mm, and a lateral dimension of the second projection lens 8 is 25 mm. FIG. 7B shows a case in which a lateral dimension of the first projection lens 5 is 40 mm, and a lateral dimension of the second projection lens 8 is 30 mm. FIG. 7C shows a case in which a lateral dimension of the first projection lens 5 is 35 mm, and a lateral dimension of the second projection lens 8 is 35 mm. In addition, vertical dimensions of the first projection lens 5 and the second projection lens 8 shown in FIG. 7A, FIG. 7B and FIG. 7C are both 20 mm.

Results obtained by measuring central luminous intensities and total luminous fluxes when the first light distribution variable lighting unit 2 and the second light distribution variable lighting unit 3 are both turned on (both are driven at IA) using the first projection lens 5 and the second projection lens 8 shown in FIG. 7A, FIG. 7B and FIG. 7C are shown in the following Table 1. In addition, Table 1 shows relative values shown in FIG. 7B and shown in FIG. 7C using the case shown in FIG. 7A as a reference (=1)

TABLE 1

| | CENTER LUMINOUS INTENSITY | | TOTAL LUMINOUS FLUX | |
|---|---|---|---|---|
| | LUMINOUS INTENSITY (cd) | RATIO | LUMINOUS FLUX (lm) | RATIO |
| FIG. 7A | 57998 | 1.00 (REFERENCE) | 938 | 1.00 (REFERENCE) |
| FIG. 7B | 59274 | 1.02 | 899 | 0.96 |
| FIG. 7C | 59736 | 1.03 | 843 | 0.90 |

As shown in Table 1, as the size of the second projection lens 8 approaches the size of the first projection lens 5 (is increased), the total luminous flux decreases. In addition, a proportion of an increase in central luminous intensity is smaller than that of a decrease in total luminous flux. Accordingly, in the lighting tool 1 for a vehicle of the embodiment, the lighting tool in which the second projection lens 8 is smaller than the first projection lens 5 can minimize power consumption while increasing the total luminous flux.

In the lighting tool 1 for a vehicle of the embodiment, as the second projection lens 8 is smaller than the first projection lens 5, the number of the light emitting devices 7*a* and 7*b* that constitute the second light distribution variable lighting unit 3 may be smaller than the number of the light emitting devices 4*a* to 4*j* that constitute the first light distribution variable lighting unit 2.

Further, the present invention is not necessarily limited to the embodiment and various modifications may be made without departing from the scope of the present invention.

For example, while the second light distribution variable lighting unit 3 has a configuration including the two light emitting devices 7*a* and 7*b*, in the case in which three or more light emitting devices are provided, it is preferable as long as a single peak intensity is caused to appear in a luminous intensity distribution of each projection image when light radiated to a side in front of the second projection lens 8 is projected with respect to a virtual vertical screen facing the second projection lens 8 by causing light emitted from the neighboring light emitting device to overlap each other.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A vehicle headlight comprising:

a first light distribution variable lighting unit and a second light distribution variable lighting unit each having a plurality of light emitting devices disposed to be aligned in a vehicle width direction and a projection lens that projects light emitted from the plurality of light emitting devices in an advancing direction of a vehicle and that are configured to variably control a light distribution pattern of the light projected by the projection lens while switching lighting of the plurality of light emitting devices, wherein, in the first light distribution variable lighting unit, the plurality of light emitting devices is a plurality of first light emitting devices in which a number of the light emitting devices is larger than a number of the light emitting devices used in the second light distribution variable lighting unit, the projection lens includes a first projection lens disposed in front of the first light emitting devices, a first separator configured to reflect light emitted from the first light emitting devices toward the first projection lens is disposed in between the first projection lens and the first light emitting devices and is provided at least in between of each of the first light emitting devices, a size of the first projection lens in a vehicle-width-direction dimension is larger than in a vertical-direction dimension, the plurality of the first light emitting devices is non-symmetrically arranged with respect to a focus of the first projection lens so that a number of the first light emitting devices on a left side and a number of the first light emitting devices on a right side are different with respect to a first light emitting device which is set as a reference center among the plurality of the first light emitting devices, the first light distribution variable lighting unit radiates light having a first light distribution pattern toward a side in front of the projection lens with respect to a predetermined radiation range, in the second light distribution variable lighting unit, the plurality of light emitting devices is second light emitting devices in which a number thereof is at least two and is less than the number of the plurality of first light emitting devices that constitute the first light distribution variable lighting unit, the projection lens includes a second projection lens disposed in front of the second light emitting devices, a size of the second projection lens in the vehicle-width-direction dimension is smaller than the size of the first projection lens in the vehicle-width-direction dimension, and the second light distribution variable lighting unit radiates light having a second light distribution pattern toward the side in front of the projection lens with respect to at least a vicinity of a reference center of the radiation range.

2. The vehicle headlight according to claim 1, wherein the lighting of the second light distribution variable lighting unit is controlled so that the light of the second light distribution pattern overlaps with the light of the first light distribution pattern, an emitted light from one of the second light emitting devices of the second light distribution variable lighting unit radiates a position between an optical axis of light emitted from the first light emitting device of the first light distribution variable lighting unit which is set as the reference center and an optical axis of light emitted from the first light emitting device which is next on a left side to the first light emitting device set as the reference center, an emitted light from another one of the second light emitting devices of the second light distribution variable lighting unit radiates a position between the optical axis of light emitted from the first light emitting device of the first light distribution variable lighting unit which is set as the reference center and an optical axis of light emitted from the first light emitting device which is next on a right side to the first light emitting device set as the reference center, and a luminous intensity of light radiated to the vicinity of the reference center of the radiation range is maximized by causing the light having the second light distribution pattern to overlap the light having the first light distribution pattern.

3. The vehicle headlight according to claim 1, wherein the second light distribution variable lighting unit causes a single peak intensity to appear in a luminous intensity distribution of a projection image when light radiated to a side in front of the projection lens is projected with respect to a virtual vertical screen facing the projection lens by causing light emitted from neighboring light emitting devices to overlap each other.

4. The vehicle headlight according to claim 1, wherein the projection lens has an optical diffusion section configured to diffuse light emitted from the projection lens.

5. The vehicle headlight according to claim 1, wherein the second light distribution variable lighting unit has a separator configured to reflect light emitted from each of the second light emitting devices toward the projection lens.

6. The vehicle headlight according to claim 2, wherein the second light distribution variable lighting unit causes a single peak intensity to appear in a luminous intensity distribution of a projection image when light radiated to a side in front of the projection lens is projected with respect to a virtual vertical screen facing the projection lens by causing light emitted from the neighboring light emitting devices to overlap each other.

7. The vehicle headlight according to claim 2, wherein the projection lens has an optical diffusion section configured to diffuse light emitted from the projection lens.

8. The vehicle headlight according to claim 1, wherein the plurality of the second light emitting devices of the second light distribution variable lighting unit causes a single peak intensity to appear in a luminous intensity distribution of a projection image when light radiated to the side in front of the projection lens is projected with respect to a virtual vertical screen facing the second projection lens by causing light emitted from the neighboring second light emitting devices to overlap each other.

9. The vehicle headlight according to claim 2, wherein the plurality of the second light emitting devices of the second light distribution variable lighting unit causes a single peak intensity to appear in a luminous intensity distribution of a projection image when light radiated to a side in front of the projection lens is projected with respect to a virtual vertical screen facing the second projection lens by causing light emitted from neighboring second light emitting devices to overlap each other.

10. The vehicle headlight according to claim 1, wherein the size of the first projection lens in the vertical direction and a size of the second projection lens in the vertical direction are 20 mm or less.

* * * * *